US005937534A

United States Patent [19]

Anderson et al.

[11] Patent Number: 5,937,534

[45] Date of Patent: Aug. 17, 1999

[54] PAINT SPINNER

[76] Inventors: David Anderson, 1667 S. Tonopah Ave., West Covina; Anthony Rosas, 757 Rancho El Fuerte, Covina, both of Calif. 91724

[21] Appl. No.: 08/669,930

[22] Filed: Jun. 25, 1996

Related U.S. Application Data

[63] Continuation of application No. 08/550,621, Oct. 31, 1995, abandoned.

[51] Int. Cl.[6] ..... F26B 17/30

[52] U.S. Cl. ..... 34/58

[58] Field of Search ..... 34/58; 192/65, 192/79, 107 T, 109 R; 248/522, 565, 652, 655, 665; 15/65; 366/276; 411/191, 196, 197, 221

[56] References Cited

U.S. PATENT DOCUMENTS

| | | | |
|---|---|---|---|
| 2,794,265 | 6/1957 | Kruger | 34/58 |
| 2,884,709 | 5/1959 | Kruger | 34/58 |
| 5,621,979 | 4/1997 | Taylor | 34/58 |
| 5,630,284 | 5/1997 | Huang | 34/58 |

*Primary Examiner*—Henry Bennett
*Assistant Examiner*—Steve Gravini
*Attorney, Agent, or Firm*—Robert D. Fish; Crockett & Fish

[57] ABSTRACT

A paint spinner uses a Yankee screwdriver or other mechanism having a driving rod with some combination of an unusually tight winding or gearing, an overlength rod, gearing of the drive shaft, a slip clutch and a flywheel to rotate a small diameter roller cover at speeds in excess of 800 revolutions per minute which are sufficient to clean the roller cover.

6 Claims, 1 Drawing Sheet

PAINT SPINNER

This application is a continuation of application Ser. No. 08/550,621 filed Oct. 31, 1995, now abandoned.

FIELD OF THE INVENTION

The present invention relates to the field of painting, and more particularly to the cleaning of reusable paint roller covers.

BACKGROUND OF THE INVENTION

It has been known for many years to paint walls, ceilings, canvasses and other surfaces with rollers as opposed to brushes, sponges or other devices. While some rollers are intended for single use, others are intended to be reused, and must be cleaned. Depending on the thickness and type of material used in the nap of the roller cover, cleaning of the roller covers in particular can be messy and time consuming, and can utilize an inordinate amount of solvent.

Numerous devices have been developed over the years for cleaning roller covers. One such device is the paint spinner, which engages a roller cover from one end, and rotates it along its longitudinal axis with sufficient rapidity to expel the paint from the cover by centrifugal force. It is known to use such paint spinners under a water faucet, in the open air, or inside a bucket or solvent container which is capable of catching the expelled paint. It is also known to use various means of spinning the roller cover, including adaptations to electric drills, hand powered rotary drills, and what is colloquially known as a Yankee screwdriver mechanism.

In the Yankee screwdriver mechanism, a spiraled or twisted driving rod is reciprocated inside a hub, causing a chuck or clamp to rotate in a single direction. Mechanisms operating according to this principle have been known for many years, particularly with respect to hand-operated screwdrivers and drills, and its application to paint spinners is described in U.S. Pat. Nos. 2,794,295, 2,884,709 and 2,912,769 to Kruger, each of which are incorporated herein in their entirety. Paint spinners utilizing the Yankee screwdriver mechanism are commercially successful, and are generally available through outlets catering to commercial painters.

One major advantage of the Yankee screwdriver mechanism is that it is hand operated, and it can therefore be utilized without proximity or connection to an electrical outlet. One of the drawbacks, however, of using a hand-operated as opposed to a motor operated paint spinner is that the roller cover can only be spun at a relatively slow speed. Commercially available paint spinners utilizing the Yankee screwdriver mechanism, for example, rotate the roller cover at only about 400 revolutions per minute. This is adequate for roller covers having an outer diameter of about two inches or more, but is inadequate for rotating roller covers of significantly smaller diameters, such as "weenie" roller covers having an outer diameter of only about one inch.

SUMMARY OF THE INVENTION

The present invention arises from the surprising discovery that the Yankee screwdriver mechanism can be adapted to operate paint spinners with paint roller covers having an outside diameter of less than or equal to one inch. In one aspect of the invention the twisting or spiraling (winding) of the driving rod can be tightened such that the roller spins in excess of 800 revolutions per minute. Alternatively or additionally, the drive mechanism can be geared up such that a driving rod having a known degree of winding will also spin the roller in excess of 800 revolutions per minute. In another aspect of the invention, a slip clutch and flywheel can be coupled to the drive mechanism such that the roller cover continues to spin even during periods when the driving rod is not being operated.

BRIEF DESCRIPTION OF THE DRAWINGS

In the drawing, wherein the same reference characters denote similar elements throughout the several views.

DETAILED DESCRIPTION OF THE DRAWINGS

The departure from previous paint spinners, and advantages of the new devices disclosed herein will become more readily apparent on examination of the following descriptions.

Figure 1:
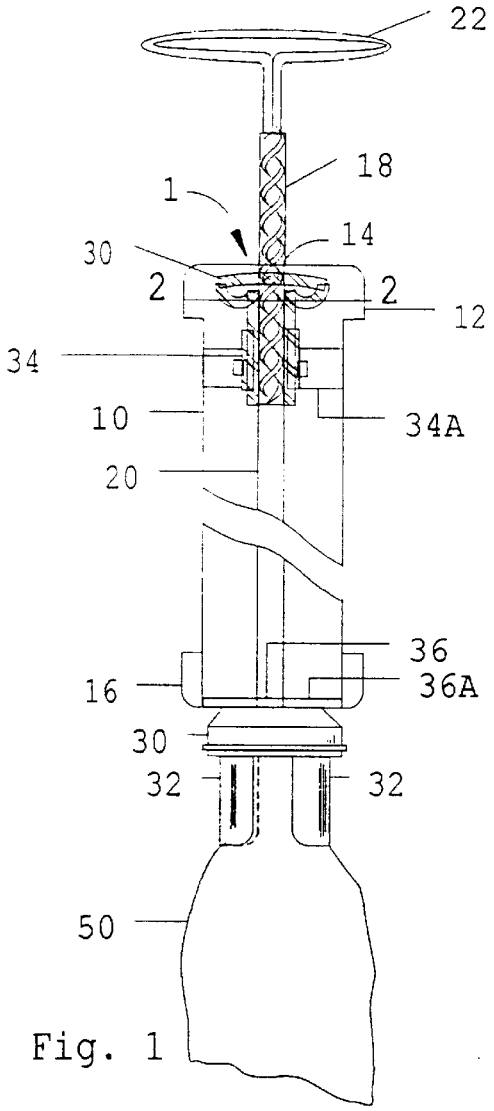
FIG. 1 is an enlarged fragmentary vertical sectional view of a paint spinner after U.S. Pat. No. 2,794,265, but with a longer stroke and/or a tighter winding.

In FIG. 1 a paint spinner 1 generally comprises a barrel shaped housing 10, a driving rod 18, and a connecting mechanism 30, all of which are similar in appearance and operation to corresponding components in the appliance of FIG. 1 of the U.S. Pat. No. 2,794,265, (the '265 patent). Thus, the housing 10 is generally cylindrical, predominantly hollow, and is manufactured from a rigid material such as steel, aluminum alloy or hard plastic similar to housing 10 in FIG. 1 of the '265 patent. The driving rod 18 is similar in appearance and operation to the driving rod 18 of FIG. 1 of the '265 patent, and is advantageously formed by twisting a length of flat strip stock such as stainless steel or aluminum alloy. At one end of housing 10 the driving rod 18 is formed into a handle, and an upper end cap 12 is present where the driving rod 18 enters the housing through passageway 14. At the other end of housing 10, drive shaft 20 passes through the opening (not shown) of bottom end cap 16, and is coupled to two opposing clips 32 via connecting mechanism 30. Clips 32 frictionally approximate a roller cover 50.

Unlike the driving rod of the '265 patent and previously known paint spinners, in which there is only one complete twist or winding for every two linear inches of twisted rod, the twisting of the driving rod in one embodiment of the present invention is considerably tightened so that there is at least approximately one complete twist per linear inch of twisted rod. The increased twisting preferably serves to at least double, and in some cases triple the speed at which the roller cover rotates.

In another improvement, driving rod 18 can be made relatively longer than is presently known. In the '265 patent, and indeed in known commercially available paint spinners, the driving rod is only of sufficient length relative to the winding that a single up and down stroke produces less than three complete turns of the paint roller. This is adequate for rollers having an outside diameter of two inches and larger, but is completely inadequate for cleaning smaller rollers having an outside diameter of 1.5 inches or less. By increasing the winding as described above, and especially if the increased winding is accompanied by an increase in the effective length of the driving rod. A paint spinner can be adapted to properly clean smaller rollers. In particular, the relative length and winding of the driving rod can be modified such that a single up and down stroke rotates an attached roller cover by at least ten complete rotations, and in normal operation the paint spinner can rotate a roller cover at a speed of 800 rotations per minute or more.

Figure 2:
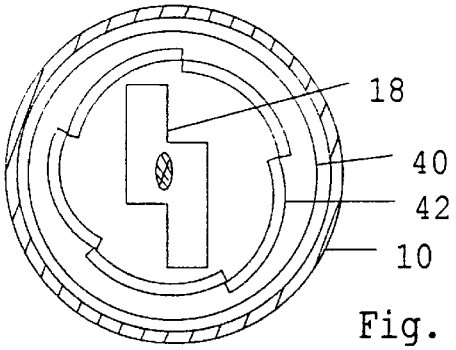
FIG. 2 is an enlarged plan view of the driving means substantially along line 2—2 of FIG. 1.

FIG. 2 provides additional detail on the operation of the mechanisms which converts reciprocating linear movement of into rotational movement in various embodiments of the inventive spinner. Again, in a manner analogous to that shown in the '265 patent, driving rod 18 cooperates with a cam driven member 40 which is mounted inside the upper portion housing 10. Member 40 is provided with peripheral spaced saw-cut teeth 42 which engage the driving rod 18, and rotates along with drive shaft 20 as rod 18 is reciprocated up and down.

Figure 3:
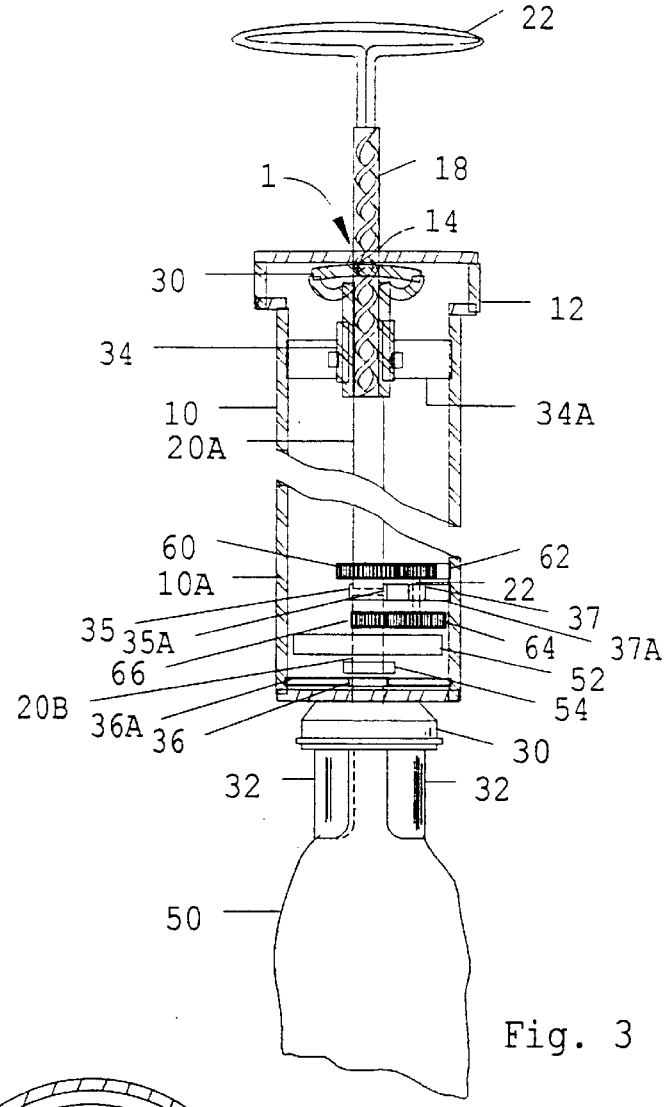
FIG. 3 is an enlarged fragmentary vertical sectional view of an alternative embodiment of the paint spinner of FIG. 1, which employs gears, a flywheel, and a slip clutch to increase the turning speed of the roller cover.

FIG. 3 shows the operation of an alternative paint spinner in which housing 10 has been replaced by housing 10A and drive shaft 20 is replaced by collinear drive shafts 20A and 20B. A third drive shaft, shaft 22, is parallel but radially peripheral to shafts 20A and 20B, and is gearingly coupled to shafts 20A and 20B by gears 60, 62, 64 and 66 as shown. Gear 60 and 62 intermesh, with gear 60 having more teeth than gear 62, and gears 64 and 66 intermesh, with gear 64 having more teeth than gear 64, such that shaft 20B rotates faster than shaft 20A. Bearings are used to support each of the shafts, with shaft 20A begin supported at its upper and lower ends by upper bearing 34 and middle bearing 35 respectively, shaft 20B being supported at its upper and lower ends by middle bearing 35 and lower bearing 36 respectively, and shaft 36 being supported by peripheral bearing 37. Bearings 34, 35, 36 and 37 are coupled to the housing by bearing supports 34A, 35A, 36A and 37A respectively.

Also seen in FIG. 3, a flywheel 52 and slip clutch 54 are optionally coupled to shaft 20B such that the roller cover 50 can continue to spin even during periods when the driving rod 18 is not being operated. These improvements are particularly useful when using smaller roller covers because of their relatively light weight, and the relatively high rotational speeds needed to effectively clean the rollers.

There are, of course, numerous alternative embodiments to that described above which are nevertheless in keeping with the inventive subject matter disclosed and claimed herein. For example, the flywheel 52 and slip clutch 54 could be affixed at other points on shaft 20B than shown, or alternatively could be affixed to shaft 20A. An analogous flywheel and slip clutch could also be used without the gearing arrangement, as for example, on a spinner as shown in FIG. 1. The gearing arrangement of FIG. 4 need not be exactly as depicted in the figure, and numerous alternative mechanisms would be apparent to those of ordinary skill in the art. Similarly, alternatives to the cam-actuated driving rod mechanism shown in FIGS. 1–3 may be used, including, for example, a rack and pinion mechanism.

Thus, embodiments of a new type of paint spinner have been disclosed. While specific embodiments and applications have been shown and described, it would be apparent to those skilled in the art that additional modifications are possible without departing from the inventive concepts herein. The invention, therefore, is not to be restricted except in the spirit of the appended claims.

What is claimed is:

1. An improved paint spinner comprising:

a hand-operated driving rod which is linearly reciprocated to impart rotation to a weenie paint roller cover through a reduction gear meshed drive mechanism, the driving rod having a handle at one end, a considerably tight winding at the center portion, and a multiple gear arrangement at an opposite end;

the reduction gear meshed drive mechanism including a separate shaft which is further coupled to the weenie paint roller such that the rotational speed of the separate shaft is much greater than the rotational speed of the driving rod; and coupling of a slip clutch to the drive shaft such that the drive shaft swivels freely when the driving rod is linearly reciprocated in one direction and then engages the driving rod when the driving rod is linearly reciprocated in the opposite direction;

which is effective to rotate the roller cover at speeds in excess of 800 revolutions per minute.

2. The spinner of claim 1 wherein the improvement is sufficient to rotate the roller cover at speeds in excess of 1200 revolutions per minute.

3. The spinner of claim 1 wherein the improvement is sufficient to rotate the roller cover at speeds in excess of 1800 revolutions per minute.

4. An improved paint spinner comprising:

a hand-operated driving rod which is linearly reciprocated to impart rotation to a weenie paint roller cover through a reduction gear meshed drive mechanism, the driving rod having a handle at one end, a considerably tight winding at the center portion, and a multiple gear arrangement at an opposite end;

the reduction gear meshed drive mechanism including a separate shaft which is further coupled to the weenie paint roller such that the rotational speed of the separate shaft is much greater than the rotational speed of the driving rod; and coupling of a slip clutch to the drive shaft such that the drive shaft swivels freely when the driving rod is linearly reciprocated in one direction and then engages the driving rod when the driving rod is linearly reciprocated in the opposite direction;

which is effective to rotate the roller cover in excess of 10 rotations per stroke of reciprocation of the driving rod.

5. The paint spinner of claim 4 wherein the induced rotation is in excess of 20 rotations per stroke of reciprocation.

6. The paint spinner of claim 4 wherein the induced rotation is in excess of 30 rotations per stroke of reciprocation.

* * * * *